US011261671B2

(12) United States Patent
Macek et al.

(10) Patent No.: US 11,261,671 B2
(45) Date of Patent: Mar. 1, 2022

(54) MULTI-FLOW COMPACTION/EXPANSION JOINT

(71) Applicant: Halliburton Energy Services, Inc., Houston, TX (US)

(72) Inventors: Mark Douglas Macek, Tyler, TX (US); Matthew Lee Thornburg, Rockwall, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/899,260

(22) Filed: Jun. 11, 2020

(65) Prior Publication Data

US 2021/0388681 A1 Dec. 16, 2021

(51) Int. Cl.
*E21B 17/06* (2006.01)
*E21B 17/18* (2006.01)

(52) U.S. Cl.
CPC ..... *E21B 17/06* (2013.01); *E21B 17/18* (2013.01)

(58) Field of Classification Search
CPC ..... E21B 17/06; E21B 17/18
See application file for complete search history.

(56) References Cited

U.S. PATENT DOCUMENTS

| | | | | |
|---|---|---|---|---|
| 7,357,188 | B1 * | 4/2008 | Cook | B21D 39/203 166/207 |
| 7,810,560 | B2 | 10/2010 | Lembcke | |
| 9,574,408 | B2 | 2/2017 | Cochran et al. | |
| 9,816,330 | B2 | 11/2017 | Delzell et al. | |
| 10,145,209 | B2 | 12/2018 | McGuire et al. | |
| 10,301,888 | B2 | 5/2019 | Richards et al. | |
| 10,443,350 | B2 | 10/2019 | Cleven | |
| 2006/0096762 | A1 * | 5/2006 | Brisco | E21B 43/105 166/384 |
| 2009/0038802 | A1 | 2/2009 | Lucas | |
| 2009/0283279 | A1 | 11/2009 | Patel et al. | |
| 2016/0123093 | A1 | 5/2016 | Richards et al. | |
| 2016/0273287 | A1 | 9/2016 | Scott et al. | |
| 2016/0329648 | A1 | 11/2016 | Dittmer et al. | |
| 2017/0183919 | A1 | 6/2017 | Cochran et al. | |
| 2018/0010416 | A1 | 1/2018 | Vander Velde et al. | |
| 2019/0186232 | A1 | 6/2019 | Ingram | |
| 2019/0257159 | A1 | 8/2019 | Dietz | |

FOREIGN PATENT DOCUMENTS

GB 2434603 A 1/2007

* cited by examiner

*Primary Examiner* — Taras P Bemko
(74) *Attorney, Agent, or Firm* — Scott Richardson; Parker Justiss, P.C.

(57) ABSTRACT

This disclosure provides an expansion joint apparatus that has a releasable coupler that holds the tool in a locked position for run-in purposes. Once in position, the releasable coupler can be activated to release a tubular housing from an outer mandrel located within the tubular housing to allow for independent movement between the tubular members comprising the expansion joint apparatus.

26 Claims, 12 Drawing Sheets

MULTI-FLOW COMPACTION/EXPANSION JOINT

BACKGROUND

Compaction/expansion joints are commonly used in oil field well completions to compensate for tubing movement that occurs due to changes in temperature, pressure, formation compaction or a combination of any of these, during normal well operations after one or more packers have been set. These joints enable relative movement between two fixed assemblies in the event of thermal expansion or contraction. The forces generated by thermal expansion or contraction can be significant. Expansion joints within the completion assembly inhibit movement or forces being transmitted to fixed components such as packers or tubing hangers and maintain the pressure integrity of the tubing while allowing the string to safely expand and contract. However, in present multi-completion technologies, higher fluid flow volumes are often required to perform various completion operations, such as frac or gravel pack operations.

BRIEF DESCRIPTION

Reference is now made to the following descriptions taken in conjunction with the accompanying drawings, in which.

DETAILED DESCRIPTION

Figure 1:
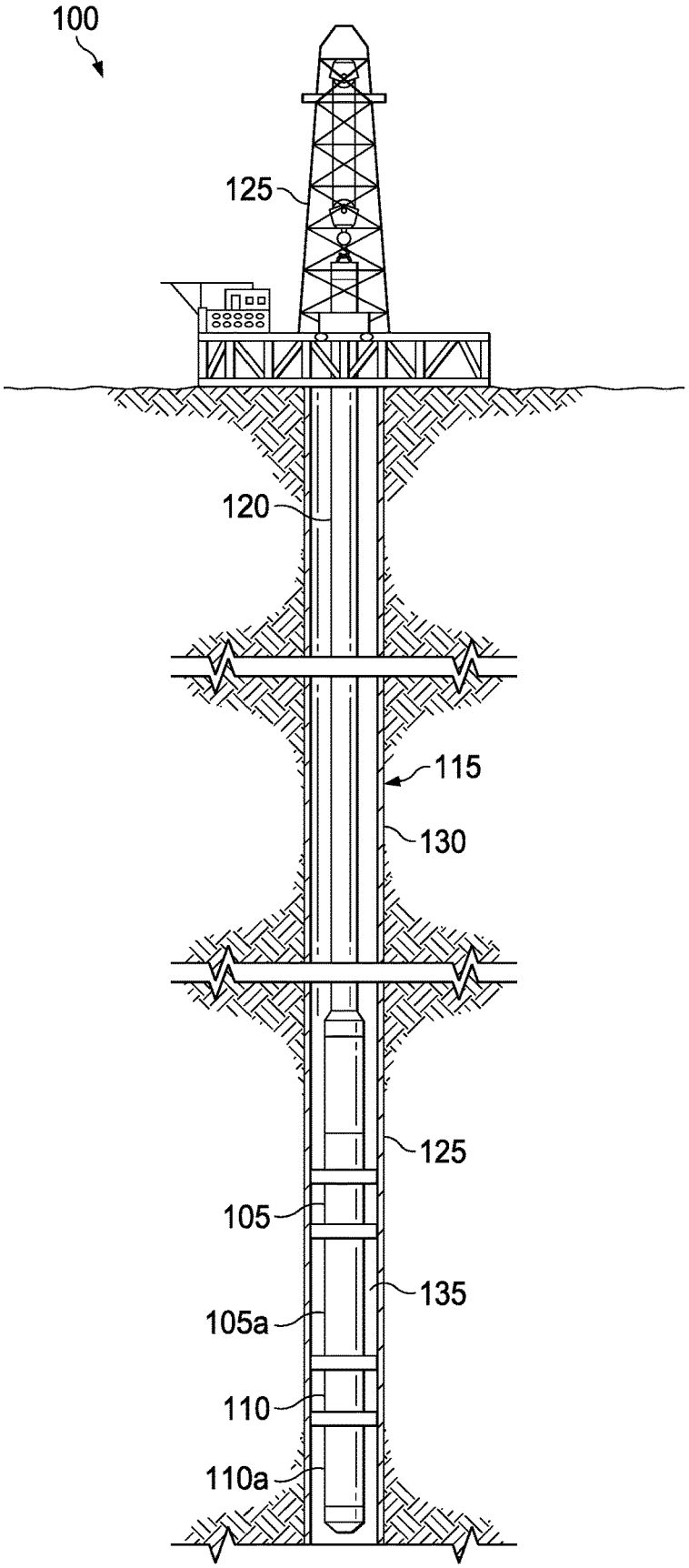
FIG. 1 illustrates a well completion system in which one or more of the embodiments of the expansion joint apparatus of this disclosure may be implemented.

Provided is an expansion joint apparatus that offers the ability, in a single trip and with limited running tool manipulation, that is couplable to a completion system and that can be used in reverse out operations to provide improved reverse out flow rates. The word "expansion," as used herein and in the claims, is meant to include other wellbore forces, such as compaction, expansion, or contraction, and therefore, is not limited to only expansion forces. This disclosure provides an expansion joint apparatus that has a releasable coupler that holds the tool in a solid position for run-in purposes. Once in position, the releasable coupler can be activated to release a tubular housing from an outer mandrel located within the tubular housing to allow for independent movement between the tubular members comprising the expansion joint apparatus, thereby providing a tubing system that better accommodates compaction, expansion or contraction forces applied against the completion string in the wellbore. This independent movement mitigates completion tubing damage that can occur as a result of movement forces caused by expansion, contraction or compaction of the geological formations in which the expansion joint apparatus extends. Furthermore, the expansion joint apparatus includes concentric pipes that form concentric flow paths that provide for greater fluid volume flow through the device, which is often required by multi-completion apparatus. These concentric paths provide a reverse flow path that can take returns and reverse excess proppant from the wellbore associated with completion processes.

It is known that to reverse out proppants, such as fracking sand, efficiently, a certain velocity, and flow area is required. The embodiments of the expansion joint apparats, as provided by this disclosure, not only allows for independent movement of the internal and external tubing, which mitigates completion tubing damage, but it also provides a system that allows for improved cleanout rates and reverse out flow rates through the internal concentric flow paths. Further, the expansion joint apparatus can be connected in sequence within the wellbore.

The concentric flow paths of the expansion joint apparatus fluidly connect to internal and reverse out flow paths of a completion assembly that can be fluidly connected to an internal longitudinal flow path of the completion assembly. The expansion apparatus can be easily connected to known completion and adapter assemblies at the drilling site with minimal assembly effort that can be used with known running tools to provide higher reverse out fluid rates than known systems, while providing for independent movement of the tubular housing and the outer mandrel.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," or any other term describing an interaction between elements includes not only direct connection, unless specified, but indirect connection or interaction between the elements described, as well. As used herein and in the claims, the word "configure," including spelling variations thereof, means that the recited elements are connected either directly or indirectly in a manner that allows the stated function to be accomplished and include the requisite physical structure(s) that is/are necessary to accomplish the stated function.

In the following discussion and in the claims, the terms "including" and "comprising" are used in an open-ended fashion, and thus mean "including, but not limited to." Further, references to up or down are made for purposes of description purposes only and are not intended to limit the scope of the claimed embodiments in any way, with "up," "upper," or "uphole," meaning toward the surface of the wellbore and with "down," "lower," "downward," "downhole," or "downstream" meaning toward the terminal end of the well, as the multi-functional well completion assembly would be positioned within the wellbore, regardless of the wellbore's orientation. Further, any references to "first," "second," etc. do not specify a preferred order of method or importance, unless otherwise specifically stated, but such terms are for identification purposes only and are intended to distinguish one element from another. The term "longitudinal" is used herein, and in the claims, regarding certain flow paths. However, this term is meant to indicate a general direction only, which is generally along a longitudinal axis of the apparatus, even though it may or may not be parallel with the longitudinal axis.

FIG. 1. Illustrates a well completion system 100 in which one or more of the embodiments of the expansion joint apparatus 105, 110, according to this disclosure, may be implemented. Each of the expansion joint apparatus 105, 110, may be sequentially connected to a completion assembly 105*a*, 110*a*, respectively. FIG. 1 schematically illustrates two expansion joint apparatus 105, 110, and associated completion assemblies 105*a*, 110*a*, positioned in a wellbore 115 and across from a zone of interest, such as a geological formation that may contain oil or gas, which is hereinafter referred to as a "zone." Though only two such assemblies 105, 110 are illustrated, one or more than two such assemblies 105, 110 may be placed in the wellbore. The expansion joint apparatus, 105, 110 may be operated simultaneously or individually. Additionally, the completions assemblies 105*a*, 110*a* may be operated sequentially. For example, once the lower zone is stimulated, the next zone, uphole from the lower zone may be stimulated, until all of the zones are stimulated, all of which may be accomplished without the need for multiple trips into and out of the wellbore 115 or moving a string of tubing 120 considerably. The well completion system 100 includes a conventional rig 125, which may be a sea drilling platform or a land platform or work-over rig. At this stage of the drilling operations, a casing 130 has been inserted into the wellbore 115 and cemented into place, which forms a well annulus 135. By way of convention in the following discussion, though FIG. 1 depicts a vertical wellbore, it should be understood by those skilled in the art that embodiments of the apparatus according to the present disclosure are equally well suited for use in wellbores having other orientations including horizontal wellbores, slanted wellbores, multilateral wellbores or the like. The drilling rig 125 supports the string of tubing 120, which is coupled to the one or more expansion joint apparatus 105, 110*a*, and respective completion assemblies 105*a*, 110, as discussed below.

Figure 2A:
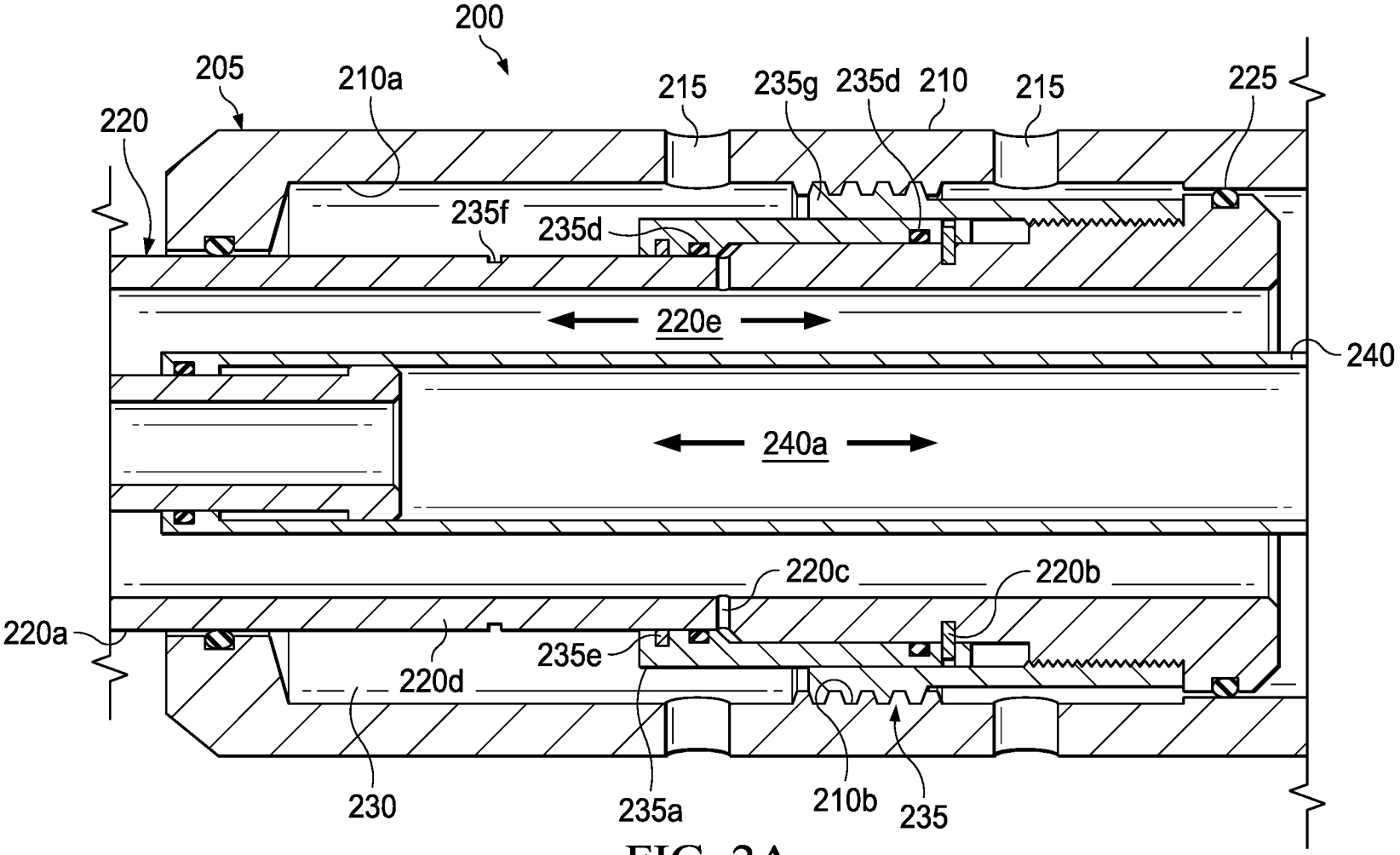
FIG. 2A illustrates a sectional view of an embodiment of an expansion joint apparatus, according to this disclosure, in a coupled configuration.

FIG. 2A illustrates a sectional view of one embodiment of an expansion joint apparatus 200, according to this disclosure. This embodiment comprises a tubular housing 205 that has a wall 210 with an interior diameter 210*a* and exterior fluid ports 215 that extend through the wall 210. An outer mandrel 220 is located within and extends into the tubular housing 205. One or more elastomeric seals 225 form a fluid seal between the tubular housing 205 and the outer mandrel 220. A portion of the outer diameter 220*a* of the outer mandrel 220 and the interior diameter 210*a* of the tubular housing 205 form a cavity 230 in which a releasable coupler 235 is slidably located. In one embodiment, as shown, the releasable coupler 235 comprises a slidable member 235*a* that is releasably coupled to the outer mandrel 220, for example by a shear pin 220*b*. The slidable member 235*a* is positioned over a fluid port 220*c* that is located through a wall 220*d* of the outer mandrel 220 and allows fluid through the fluid port 220*c* to actuate the releasable coupler 235 to release the tubular housing 205 from the outer mandrel 220. The slidable member 235*a* is slidable within the cavity 230 in response to a pressure provided against the slidable member 235*a* through the fluid port 220*c*. In certain embodiments, the slidable member 235*a* may include one or more elastomeric seals 235*d* to provide an operative fluid seal between the slidable member 235*a* and the outer mandrel 220. It may also include a snap ring 235*e* that can be received in a snap ring slot 235*f* formed in the outer diameter 220*a* to hold the slidable member 235*a* in place after activation. A latch 235*g* is located between the interior diameter 210*a* of the tubular housing 205 and an outer diameter 220*a* of the outer mandrel 220 and is supported by the slidable member 235*a*. In one embodiment, the latch 235*g* may have a crenelated or notch configuration. The crenels may have any number of geometric configurations, and therefore, is not limited to the configuration shown in this embodiment. A corresponding profile 210*b* is formed in a wall of the interior diameter 210*a* of the tubular housing 210. The corresponding profile 210*b* is engageable with the latch 235*g* to fix a position of the tubular housing 205 relative to the outer mandrel 220. In one embodiment, the corresponding profile 210*b* also has a crenelated profile that corresponds to the latch 235*g* that allows it to interlock with the corresponding profile 210*b*, and thereby secure the tubing housing 205 to the outer mandrel 220. Other known designs and configurations of releasable couplers may be used in the place of the one illustrated in the embodiment of FIG. 2A and are within the scope of this disclosure.

As discussed below, in one embodiment, the releasable coupler 235 can be activated by shearing the shear pin 220*b* and flowing fluid through the interior port 220*c*. The coupling of the tubular housing 205 to the outer mandrel 220 by the releasable coupler 235 provides an operative degree of rigidity to the expansion joint apparatus 200 to allow it to be positioned within the wellbore, effectively. However, after the proper location is achieved, the releasable coupler 235 can be optionally activated, as described below, to release the tubular housing 205 from the exterior mandrel 220, which allows independent movement between the tubular housing 205 and the exterior mandrel 220. This independent movement allows the expansion joint apparatus 200 to better accommodate or dissipate axial stresses associated with expansion, contraction, or compaction that can occur in a wellbore.

The embodiment of FIG. 2A further comprises an inner mandrel 240 that is located within the outer mandrel 220 and forms an internal flow path 240*a* through the expansion joint apparatus 200, as generally shown. The inner mandrel 240 is spaced apart from the outer mandrel 220 and forms a concentric flow path 220*e* through the expansion joint apparatus 200 that is concentric with the internal flow path 240*a*. As mentioned above, this provides the advantage of providing increased fluid flow capacity through the expansion joint apparatus 200 that is often required in high fluid volume completion processes.

Figure 2B:
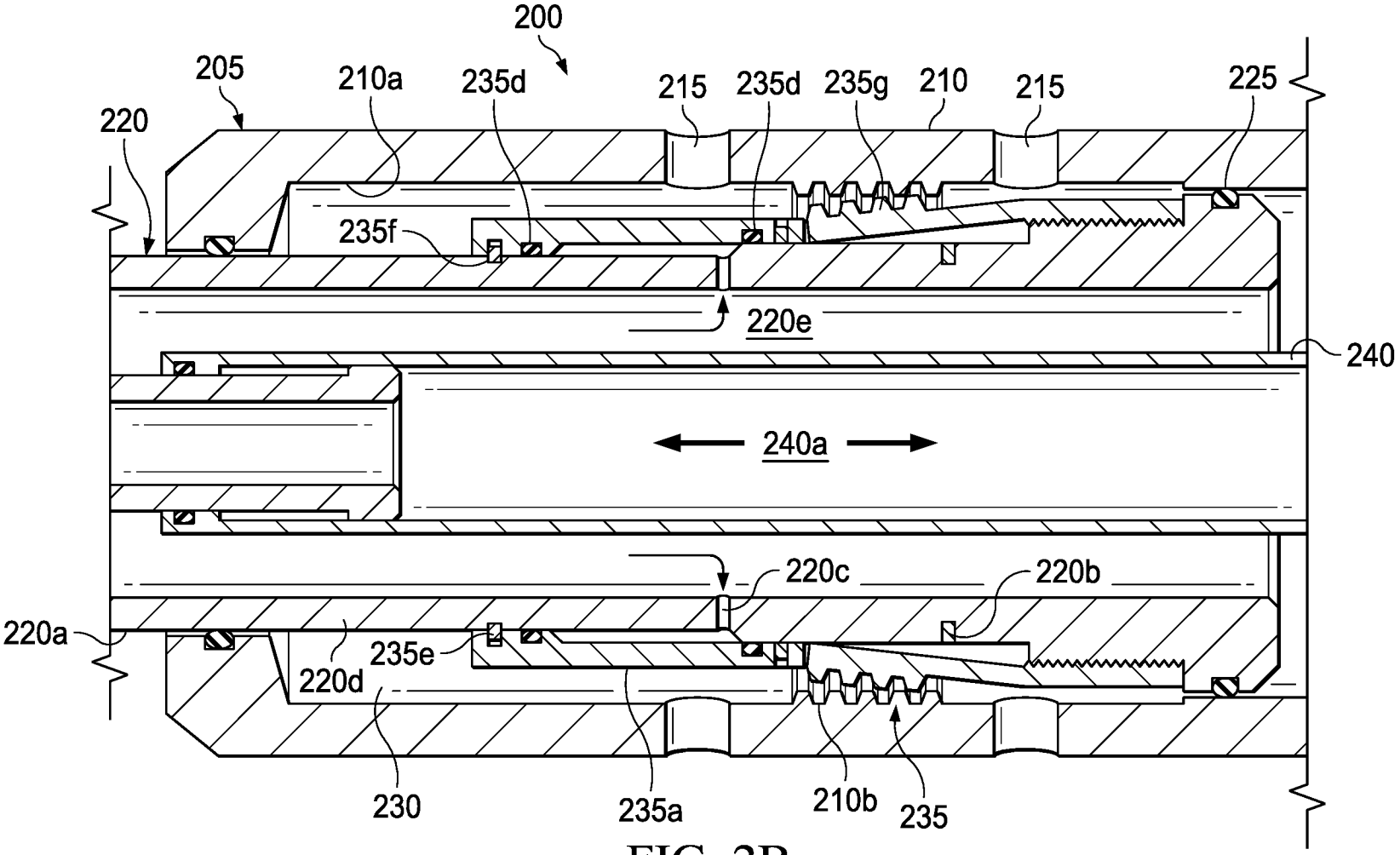
FIG. 2B illustrates a sectional view of the embodiment of FIG. 2A in a decoupled configuration.

FIG. 2B illustrates a sectional view of the embodiment of FIG. 2A in which the releasable coupler 235 has been activated to decouple the tubular housing 205 from the outer mandrel 220. As seen in this view, the shear pin 220*b* has been sheared. After the slidable member 235*a* has been released, the fluid pressure flowing through the fluid port 220*c* shifts the slidable member 235*a* uphole, as generally shown. This action removes structural support from the latch 235*g*, which allows the latch 235*g* to disengage from the corresponding profile 210*b* of the tubular housing 205. This action decouples the tubular housing 205 from the outer mandrel 220 to allow independent movement of the tubular housing 205 relative to the outer mandrel 220. This independent movement allows the expansion joint apparatus 200 to better accommodate or dissipate axial stresses associated with expansion, contraction, or compaction that can occur in a wellbore.

Figure 3A:
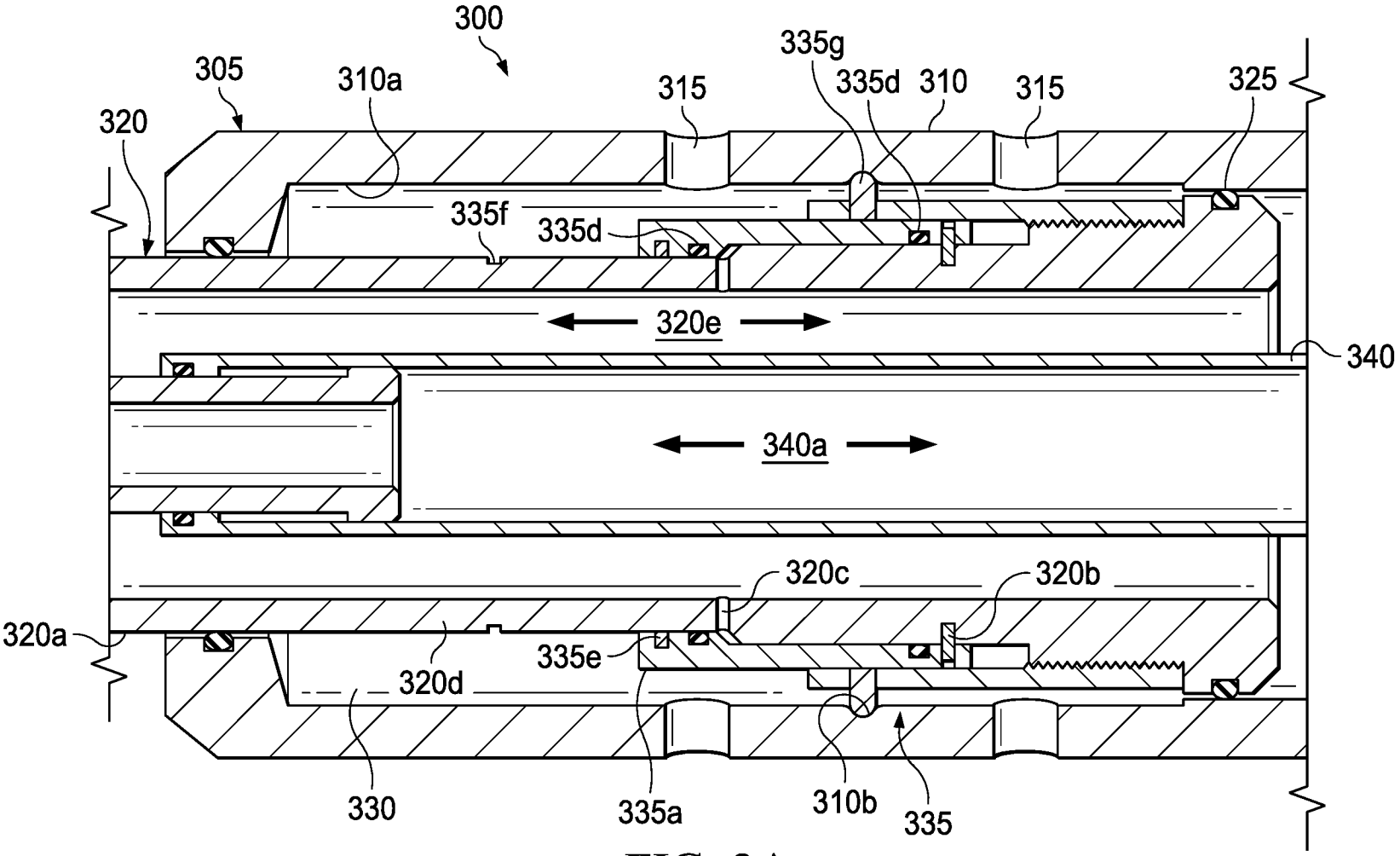
FIG. 3A illustrates a sectional view of an embodiment of an expansion joint apparatus, according to this disclosure in a coupled configuration.

FIG. 3A illustrates a sectional view of another embodiment of an expansion joint apparatus 300, according to this disclosure, in a coupled configuration. This embodiment comprises a tubular housing 305 that has a wall 310 with an interior diameter 310*a* and exterior fluid ports 315 that extend through the wall 310. An outer mandrel 320 is located within the tubular housing 305. One or more elastomeric seals 325 form a fluid seal between the tubular housing 305 and the outer mandrel 320. A portion of the outer diameter 320*a* of the outer mandrel 320 and the interior diameter 310*a* of the tubular housing 305 form a cavity 330 in which a releasable coupler 335 is slidably located. In one embodiment, as shown, the releasable coupler 335 comprises a slidable member 335*a* that is releasably coupled to the outer mandrel 320, for example by a shear pin 320*b*, and positioned over a fluid port 320*c* that is located through a wall 320*d* of the outer mandrel 320. As explained below, the fluid flow through the fluid port 320*c* actuates the releasable coupler 335 to release the tubular housing 305 from the outer mandrel 320. The slidable member 335*a* is slidable within the cavity 330 in response to a pressure provided against the slidable member 335*a* through the fluid port 320*c*. In certain embodiments, the slidable member 335*a* may include one or more elastomeric seals 335*d* to provide an operative fluid seal between the slidable member 335*a* and the outer mandrel 320. A snap ring 335*e* that can be received in a snap ring slot 335*f* formed in the outer diameter 320*a* to hold the slidable member 335*a* in place after activation, may also be present in certain embodiments. A latch 335*g* is located between the interior diameter 310*a* of the tubular housing 310 and an outer diameter 320*a* of the outer mandrel 320 and is supported by the slidable member 335*a*. In this embodiment, the latch 335*g* is a latching lug, as generally shown. A corresponding profile 310*b* is formed in a wall of the interior diameter 310*a* of the tubular housing 310. The corresponding profile 310*b*, in this embodiment, is a lug cavity that is configured to receive the latching lug and hold the tubular housing 305 in a fixed position relative to the outer mandrel 320. The corresponding profile 310*b* is engageable with the latch 335*g* to fix a position of the tubular housing 305 relative to the outer mandrel 320. Other known designs and configurations of a releasable coupler 335 may be used in the place of the one illustrated in the embodiment of FIG. 3A and are within the scope of this disclosure.

As discussed below, in one embodiment, the releasable coupler 335 can be activated by shearing the shear pin 320*b* and flowing fluid through the interior port 320*c*. The coupling of the tubular housing 305 to the outer mandrel 320 by the releasable coupler 335 provides an operative degree of rigidity to the expansion joint apparatus 300 to allow the tool to be positioned within the wellbore, effectively. However, after the proper location is achieved, the releasable coupler 335 can be optionally activated, as described below, to release the tubular housing 305 from the exterior mandrel 320, which allows independent movement between the tubular housing 305 and the exterior mandrel 320.

The embodiment of FIG. 3A further comprises an inner mandrel 340 that is located within the outer mandrel 320 and forms an internal flow path 340*a* through the expansion joint apparatus 300, as generally shown. The inner mandrel 340 is spaced apart from the outer mandrel 320 and forms a concentric flow path 320*e* through the expansion joint apparatus 300 that is concentric with the internal flow path 340*a*. As mentioned above, this provides the advantage of providing increased fluid flow capacity through the expansion joint apparatus 300 that is often required in high fluid volume completion processes.

Figure 3B:
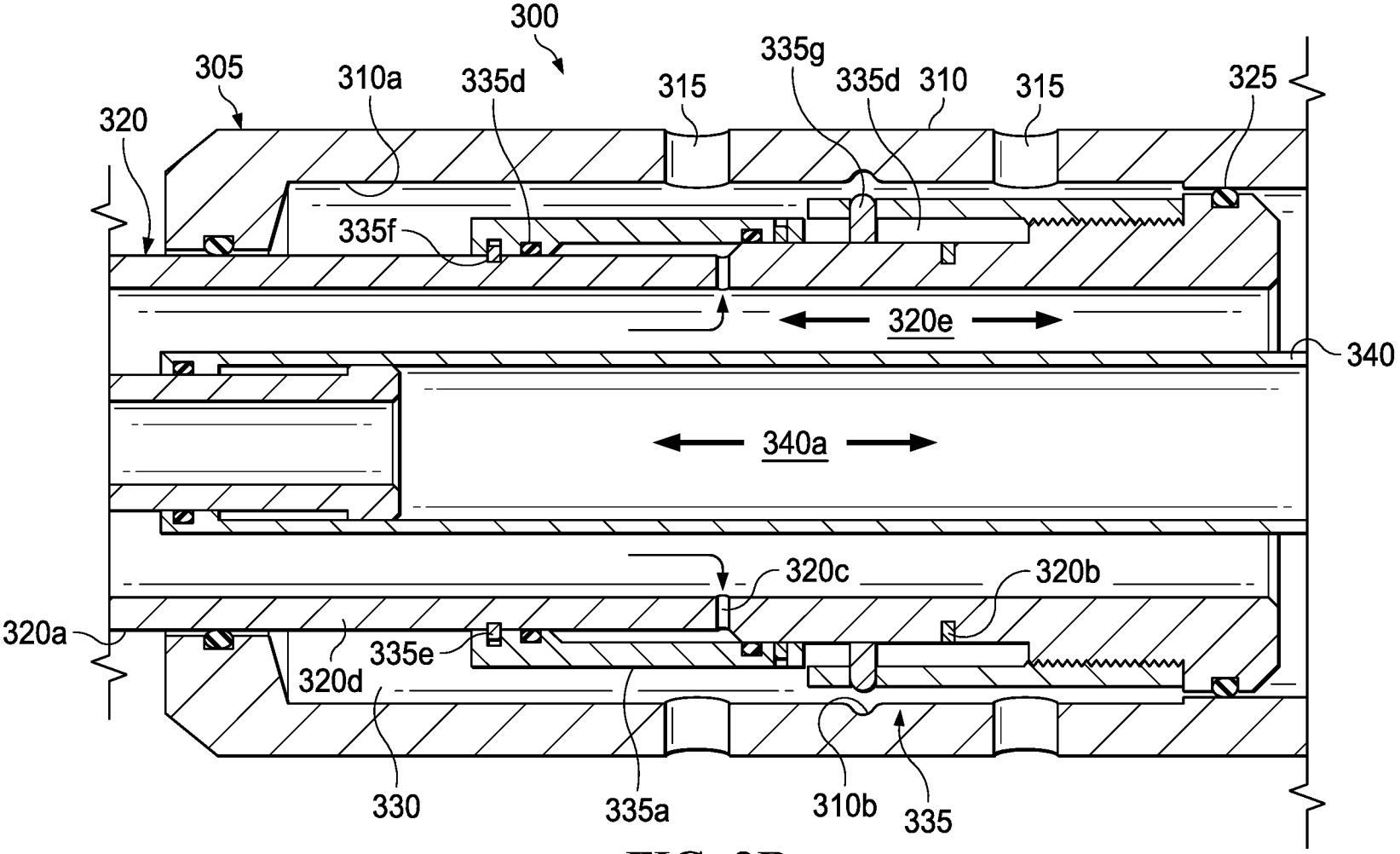
FIG. 3B illustrates a sectional view of the embodiment of FIG. 3A in a decoupled configuration.

FIG. 3B illustrates a sectional view of the embodiment of FIG. 3A in a decoupled configuration in which the releasable coupler 335 has been activated to decouple the tubular housing 305 from the outer mandrel 320. As seen in this view, the shear pin 320*b* has been sheared. After the slidable member 335*a* has been released, the fluid pressure flowing through the fluid port 320*c* shifts the slidable member 335*a* uphole, as generally shown. This action removes structural support from the latch 335*g*, which allows the latch 335*g* to disengage from the corresponding profile 310*b* of the tubular housing 305. This action decouples the tubular housing 305 from the outer mandrel 320 to allow independent movement of the tubular housing 305 relative to the outer mandrel 320. This independent movement allows the expansion joint apparatus 300 to better accommodate or dissipate axial stresses associated with expansion, contraction, or compaction that can occur in a wellbore.

Figure 4:
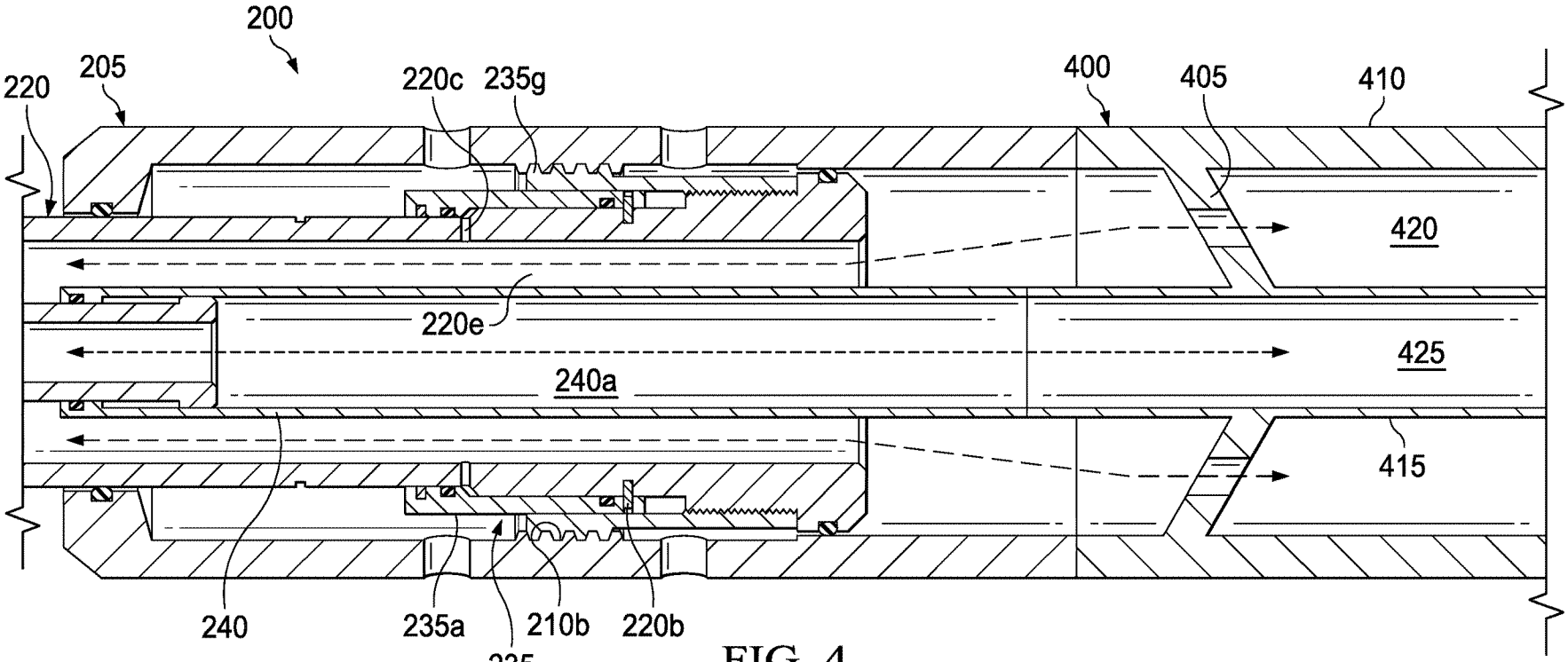
FIG. 4 illustrates a sectional view of the embodiment of FIG. 2A coupled to a downhole completion assembly.

FIG. 4 illustrates a sectional view of the embodiment of expansion joint apparatus 200 as shown in FIG. 2A coupled to a completion assembly 400. Even though FIG. 4 illustrates the embodiment of FIG. 2A, any of the embodiments of the expansion joint apparatus of this disclosure may be coupled to the completion assembly 400. Moreover, since the expansion joint apparatus 200 has been discussed above, a detailed discussion of it is not repeated here. In this embodiment, the completion assembly 400 may be any known completion assembly. For example, the completion assembly 400 may comprise a ported adapter sub 405, and other components located either uphole or downhole of the ported adapter sub 405, such as a 3-way adapter, gravel pack screen, fracing assembly, or any combination of these or other known completion assemblies. In this embodiment, the completion assembly 400 comprises an outer tubing 410 that is coupled to the tubular housing 205 of the expansion joint apparatus 200 and an inner tubing 415 that couples to the inner mandrel 240 of the expansion joint apparatus 200. The completion assembly 400 may be coupled to the expansion joint apparatus 200 by any known method. In the illustrated embodiment, the concentric flow path 220*e* of the outer mandrel 220 connects with a corresponding concentric flow path 420 of the completion assembly 400 to allow a fluid flow through the expansion joint apparatus 200 and the completion assembly 400. The internal flow path 240*a* of the inner mandrel 240 connects with a corresponding central flow path 425 of the completion assembly 400 to allow a fluid to flow through the assemblies, as generally shown. As seen, the flow paths can be bi-directional, allowing for a fluid reverse out process. The ported adapter sub 405 may include cross over ports to allow the fluid to move between concentric flow path 420 and internal flow path 425, As mentioned above, in this embodiment, the completion tool 400 comprises a ported adapter sub 405. In the illustrated embodiment of FIG. 4, the ported adapter sub 405 couples the inner tubing 415 to the outer tubing 410 in a fixed manner, thus when the expansion joint apparatus 200 is released, as described above, the tubular housing 205 and the inner mandrel 240 of the expansion joint apparatus 200, and the outer tubing 410 and the inner tubing 415 of the completion assembly 400 are allowed to move together, unitarily, in response to expansion, contraction or compaction forces within the wellbore.

Figure 5:
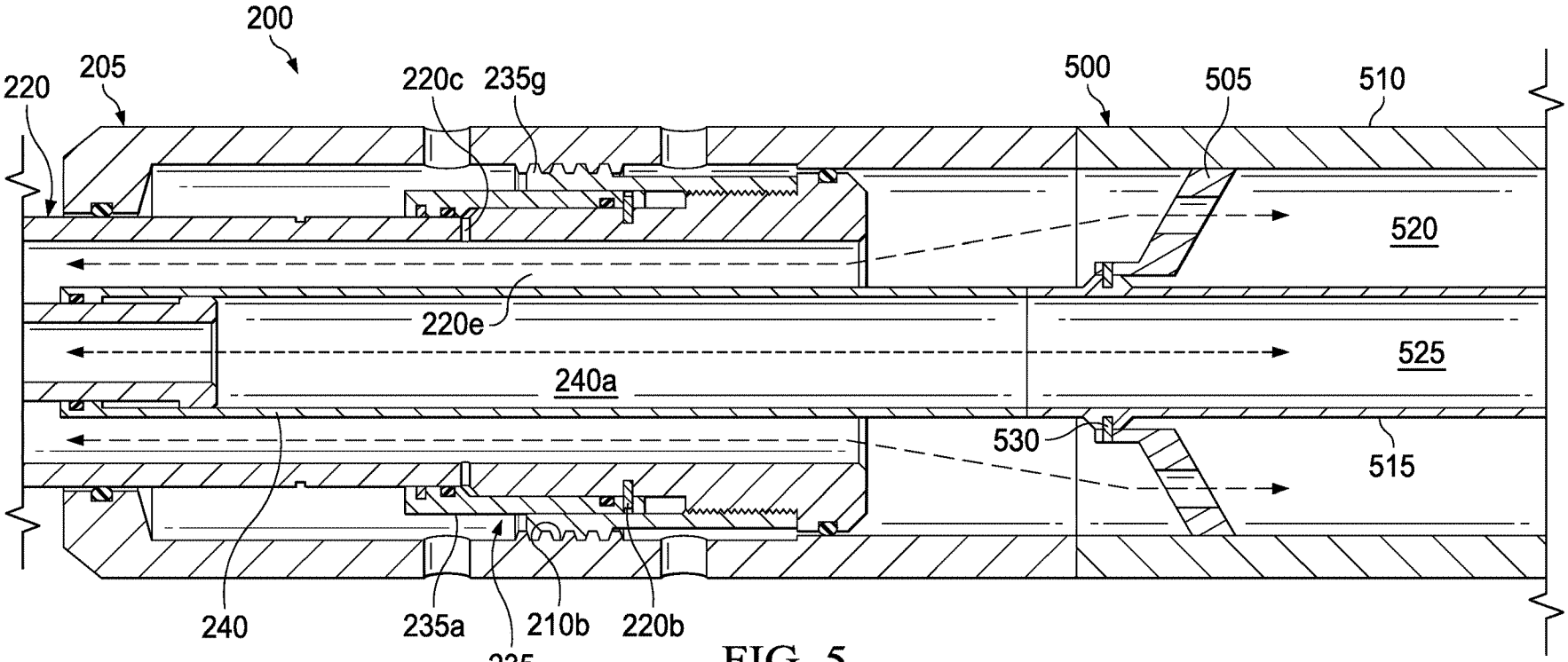
FIG. 5 illustrates a sectional view of the embodiment of FIG. 2A coupled to a downhole completion assembly wherein the inner mandrel is decouplable from the outer mandrel.

FIG. 5 illustrates a sectional view of the embodiment of the expansion joint apparatus 200 of FIG. 2A coupled to a downhole completion assembly 500. Even though FIG. 5 illustrates the embodiment of FIG. 2A, any of the embodiments of the expansion joint apparatus of this disclosure may be coupled to the completion assembly 500. Moreover, since the expansion joint apparatus 200 has been discussed above, a detailed discussion of it is not repeated here. In this embodiment, the completion assembly 500 may comprise a ported adapter sub 505, and other components located either uphole or downhole of the ported adapter sub 405, such as a 3-way adapter, gravel pack screen, fracing assembly, or any combination of these or other known completion assemblies. In this embodiment, the completion assembly 500 comprises an outer tubing 510 that is coupled to the tubular housing 205 of the expansion joint apparatus 200 and an inner tubing 515 that is coupled to the inner mandrel 240 of the expansion joint apparatus 200. The completion assembly 500 may be coupled to the expansion joint apparatus 200 by any known method. In the illustrated embodiment, the concentric flow path 220*e* of the outer mandrel 220 connects with a corresponding concentric flow path 520 of the completion assembly 500, and the internal flow path 240*a* of the inner mandrel 240 connects with a corresponding central flow path 525 of the completion assembly 500. As seen, the flow paths can be bi-directional, allowing for a fluid reverse out process. The completion tool 500 may include cross over ports to allow the fluid to move between concentric flow path 520 and internal flow path 525.

As mentioned above, the completion tool 500 comprises a ported adapter sub 505. In this embodiment, one side of the ported adapter sub 505 is releasably coupled to the inner tubing 515 and the other side is non-releasably coupled to the outer tubing 510. The ported adapter sub 505 is coupled to the inner tubing 515 by a releasable coupler 530, such as a shearing pin, however, other known types of releasable coupler mechanisms may be used. Though the illustrated embodiment shows the ported adapter sub 505 releasably coupled to the inner tubing 515, in other embodiments, the ported adapter sub 505 may be releasably coupled to the outer tubing 510 and non-releasably coupled to the inner tubing 515. The releasable coupler 530 provides flexibility in addressing stresses within a wellbore. For example, after the tubular housing 205 is released from the outer mandrel 220, as described above, it may be desirable for the tubular housing 205, the outer tubing 510, the inner mandrel 240, and the inner tubing 515 to all move as a unitary unit, being coupled together by way of the ported adapter sub 505 and releasable coupler 530. However, if well conditions require, the releasable coupler 505 may be activated to decouple the ported adapter sub 505 from the tubing to which it is releasably coupled and allow the tubular housing 205 and the outer tubing to move independently relative to the inner mandrel 240 and the inner tubing 515. Alternatively, the releasable coupler 530 may be configured to decouple when the stresses within the wellbore places sufficient force on the expansion joint apparatus 200 and the completion assembly 500. When wellbore stresses provide enough force, it can cause the releasable coupler 530 to decouple the inner tubing 515 or the outer tubing 510, depending on the configuration, from the ported adapter sub 505 to allow independent movement of tubular housing 205 and the outer tubing 510 relative to the inner mandrel 240 and the inner tubing 515. This selective independent movement provides an expansion joint apparatus 200 and completion system 500 that is capable of accommodating stresses associated with a wellbore.

Figure 6:
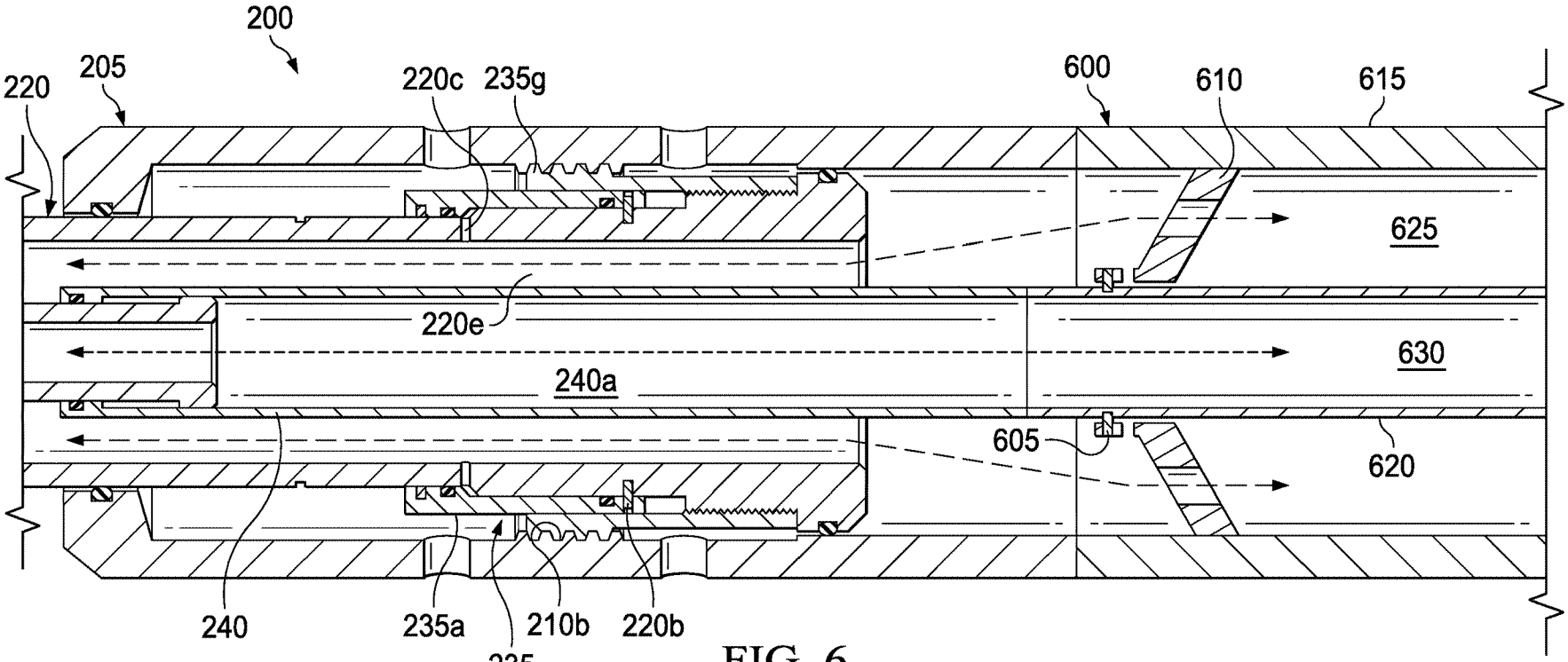
FIG. 6 illustrates a sectional view of the embodiment of FIG. 2A coupled to a downhole completion assembly showing a releasable stop to allow for additional uphole or downhole movement.

FIG. 6 illustrates a sectional view of the expansion joint apparatus 200 of the embodiment of FIG. 2A coupled to a downhole completion assembly 600 showing a limit shear pin 605 to allow for additional uphole or downhole movement. Even though FIG. 6 illustrates the embodiment of FIG. 2A, any of the embodiments of the expansion joint apparatus of this disclosure may be coupled to the completion assembly 600. Moreover, since the expansion joint apparatus 200 has been discussed above, a detailed discussion of it is not repeated here. In this embodiment, the completion assembly 600 may comprise a ported adapter sub 610, and other components located either uphole or downhole of the ported adapter sub 605, such as a 3-way adapter, gravel pack screen, fracing assembly, or any combination of these or other known completion assemblies. In this embodiment, the completion assembly 600 comprises an outer tubing 615 that is coupled to the tubular housing 205 of the expansion joint apparatus 200 and an inner tubing 620 that is coupled to the inner mandrel 240 of the expansion joint apparatus 200. The completion assembly 600 may be coupled to the expansion joint apparatus 200 by any known method. In the illustrated embodiment, the concentric flow path 220*e* of the outer mandrel 220 connects with a corresponding concentric flow path 625 of the completion assembly 600, and the internal flow path 240*a* of the inner mandrel 240 connects with a corresponding central flow path 630 of the completion assembly 600. As seen, the flow paths can be bi-directional, allowing for a fluid reverse out process. The completion tool 600 may include cross over ports to allow the fluid to move from between the concentric flow path 625 and internal flow path 630.

As mentioned above, the completion tool 600 comprises the ported adapter sub 610 where one side may be non-releasably coupled to the outer tubing 610, that is, it is not intended to decouple from the outer tubing 610 under normal well operating conditions, while the side adjacent the inner tubing 620 is free floating, that is, it is not coupled to the inner tubing 620. However, in other embodiments, the ported adapter sub 610 may be coupled to the inner tubing 620, and the side adjacent the outer tubing 615 may be free floating. The limit shear pin 605 can be positioned on either the inner tubing 620, a shown, or the inner diameter of the outer tubing 615 to allow a designed amount of downhole or uphole movement of the inner mandrel 240 and the inner tubing 620, and the tubular housing 205 and the outer tubing 615. However, in those instances where expansion, contraction, or compaction stresses become more severe than anticipated within the wellbore, the free floating side of the ported adapter sub 610 may be moved against the limit shear pin 605 with enough force to shear it. This action provides for additional independent downhole or uphole movement of the tubular housing 205 and the outer tubing 615, relative to the inner mandrel 240 and the inner tubing 620, after the expansion joint apparatus 200 is released, as described above. This force may be provided through the wellbore itself or through mechanical manipulation of the expansion joint apparatus 200. Once the limit shear pin 605 is sheared, the tubular housing 205 and the inner mandrel 240 of the expansion joint apparatus 200, and the outer tubing 615 and the inner tubing 620 of the completion assembly 600 are allowed to move independently relative to one another in response to expansion, contraction or compaction forces within the wellbore. Though the limit shear pin 605 can operate as a stop, until sufficient force shears it, it may, as mentioned above, be selectively sheared by applying the required amount of force through either the outer tubing 615 or the inner tubing 620 to shear the limit shear pin 605, which provides additional downhole or uphole movement of the tubular housing 205 and the inner mandrel 240 of the expansion joint apparatus 200 and the outer tubing 615 and the inner tubing 620 of the completion assembly 600 to accommodate stresses within the wellbore.

Figure 7:
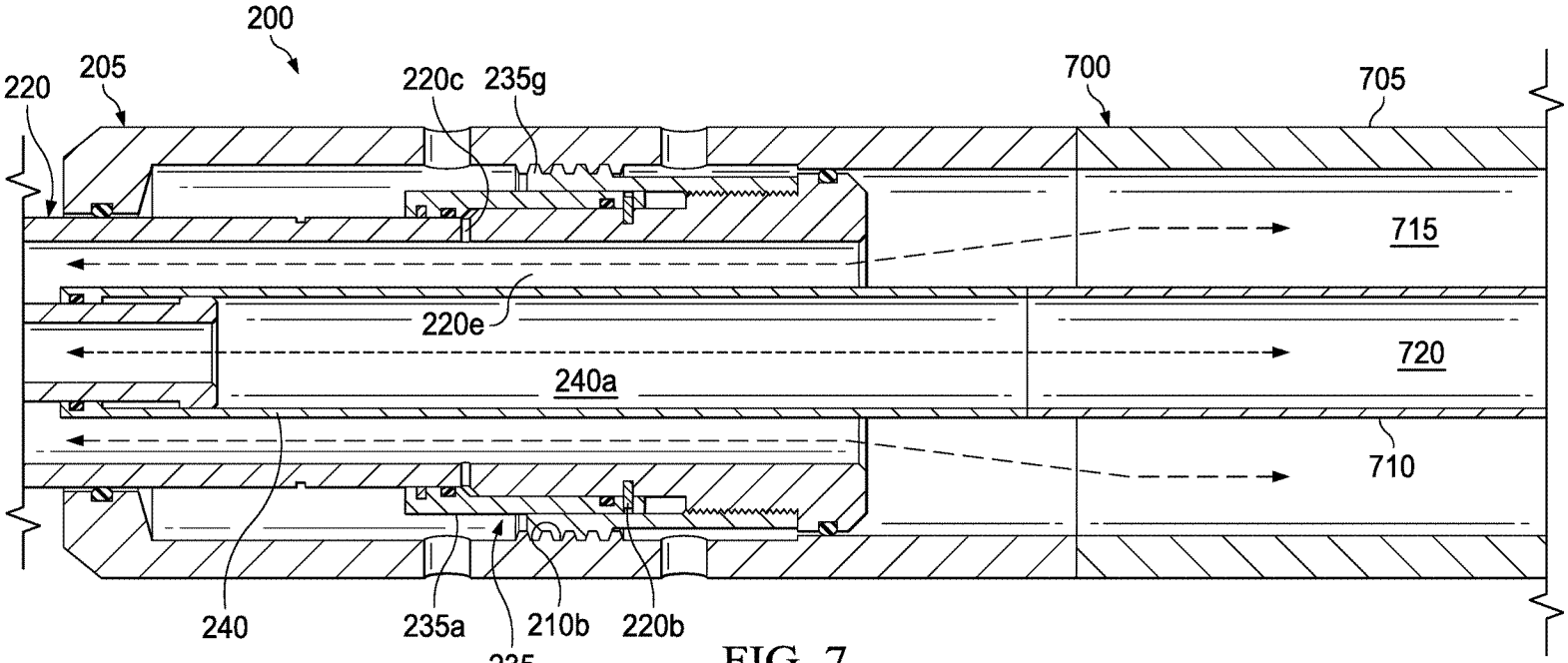
FIG. 7 illustrates the embodiment of FIG. 2A coupled to a downhole completion assembly.

FIG. 7 illustrates a sectional view of the embodiment of expansion joint apparatus 200 of FIG. 2A, coupled to a completion assembly 700. Even though FIG. 7 illustrates the embodiment of FIG. 2A, any of the embodiments of the expansion joint apparatus of this disclosure may be coupled to the completion assembly 700. Moreover, since the expansion joint apparatus 200 has been discussed above, a detailed discussion of it is not repeated here. In this embodiment, the completion assembly 700 may be any known completion assembly. For example, the completion assembly 700 may comprise a ported adapter sub, such as a 3-way adapter, gravel pack screen, fracing assembly, or any combination of these or other known completion assemblies (not shown). In this embodiment, the completion assembly 700 comprises an outer tubing 705 that is coupled to the tubular housing 205 of the expansion joint apparatus 200 and an inner tubing 710 that couples to the inner mandrel 240 of the expansion joint apparatus 200. The completion assembly 700 may be coupled to the expansion joint apparatus 200 by any known method. In the illustrated embodiment, the concentric flow path 220*e* of the outer mandrel 220 connects with a corresponding concentric flow path 715 of the completion assembly 700 to allow a fluid flow through the expansion joint apparatus 200 and the completion assembly 700. The internal flow path 240*a* of the inner mandrel 240 connects with a corresponding central flow path 720 of the completion assembly 700 to allow a fluid to flow through the assemblies, as generally shown. As seen, the flow paths can be bidirectional, allowing for a fluid reverse out process. In the illustrated embodiment of FIG. 7, the outer tubing 705 and the inner tubing 710 are respectively coupled to the tubular housing 205 and the inner mandrel 240, as generally shown, in a fixed manner, thus when the expansion joint apparatus 200 is released, as described above, the tubular housing 205 and the inner mandrel 240 of the expansion joint apparatus 200 and the outer tubing 705 and the inner tubing 710 of the completion assembly 740 are allowed to move together, independently, in response to expansion, contraction or compaction forces within the wellbore.

Figure 8:
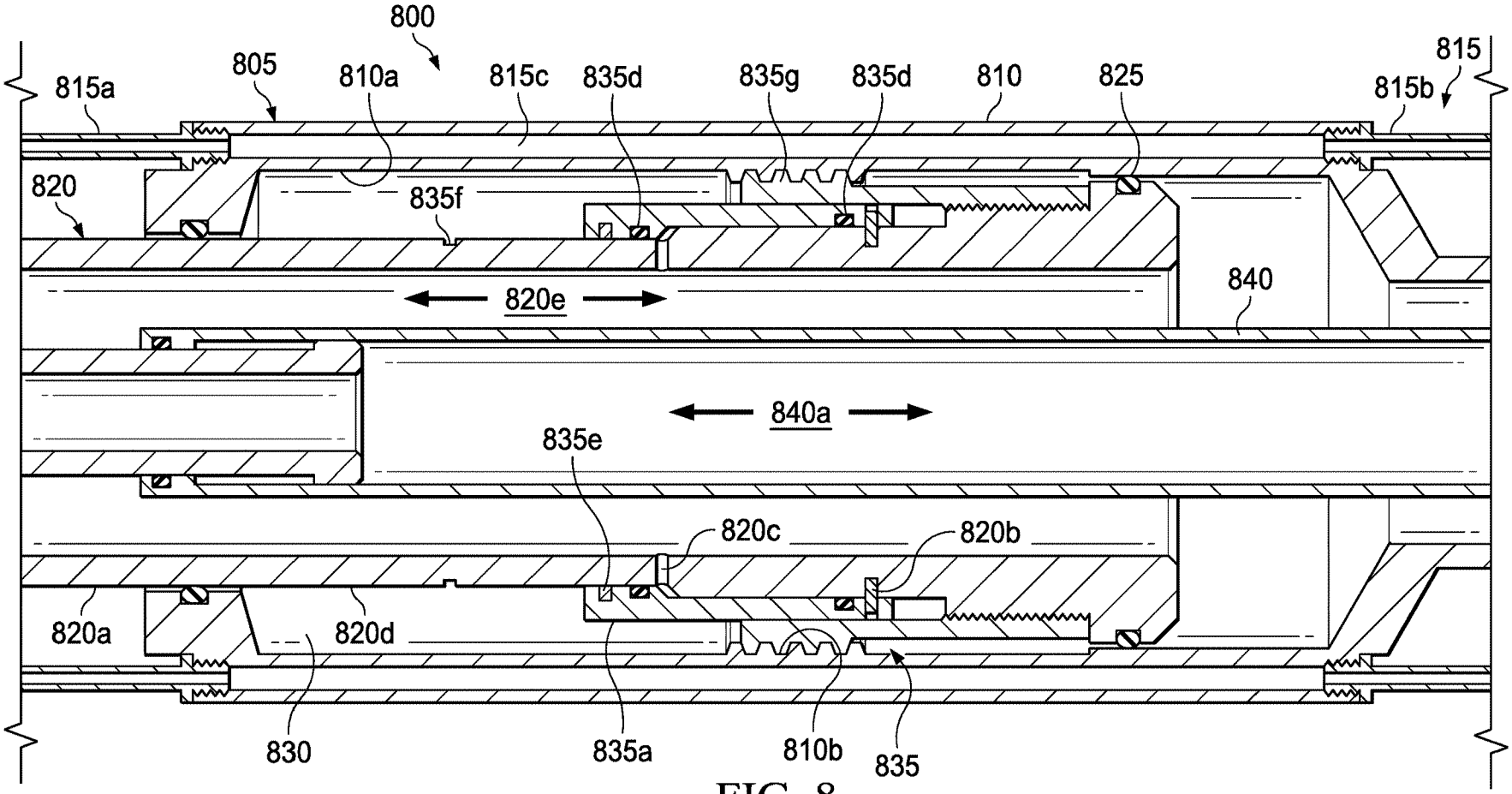
FIG. 8 illustrates a sectional view of an embodiment of an expansion joint apparatus, according to this disclosure, in a coupled configuration and having a control line extending therethrough.

FIG. 8 illustrates a sectional view of an embodiment of an expansion joint apparatus 800, according to this disclosure, in a coupled configuration, and it should be noted that this embodiment may include any of the same releasable couplers as previously mentioned regarding other embodiments, and it may be operated in a similar manner. This embodiment comprises a tubular housing 805 that has a wall 810 with an interior diameter 810*a* and a control line 815 that extends through the tubular housing 805 and within the wall 810, as generally shown. An outer mandrel 820 is located within and extends into the tubular housing 805. One or more elastomeric seals 825 form a fluid seal between the tubular housing 805 and the outer mandrel 820. A portion of the outer diameter 820*a* of the outer mandrel 820 and the interior diameter 810*a* of the tubular housing 805 from a cavity 830 in which a releasable coupler 835 is slidably located. In one embodiment, as shown, the releasable coupler 835 comprises a slidable member 835*a* that is releasably coupled to the outer mandrel 820, for example by a shear pin 820*b*. The slidable member 835*a* is positioned over a fluid port 820*c* that is located through a wall 820*d* of the outer mandrel 820 and allows fluid flow through the fluid port 820*c* to actuate the releasable coupler 835 and release the tubular housing 805 from the outer mandrel 820. The slidable member 835*a* is slidable within the cavity 830 in response to a pressure provided against the slidable member 835*a* through the fluid port 820*c*. In certain embodiments, the slidable member 835*a* may include one or more elastomeric seals 835*d* to provide an operative fluid seal between the slidable member 835*a* and the outer mandrel 820. It may also include a snap ring 835*e* that can be received in a snap ring slot 835*f* formed in the outer diameter 820*a* to slidable member 835*a* in place after activation. A latch 835*g* is located between the interior diameter 810*a* of the tubular housing 810 and an outer diameter 820*a* of the outer mandrel 820 and is supported by the slidable member 835*a*.

As with other embodiments, the latch 835*g* may have a crenelated or notch configuration. The crenels may have any number of geometric configurations, and therefore, is not limited to the configuration shown in this embodiment. A corresponding profile 810*b* is formed in a wall of the interior diameter 810*a* of the tubular housing 810 and is engageable with the latch 835*g* to fix a position of the tubular housing 805 relative to the outer mandrel 820. As with other embodiments, the corresponding profile 810*b* may also be a crenelated profile that corresponds to the latch 835*g* and that allows it to interlock with the corresponding profile 810*b*, and thereby secure the tubing housing 805 to the outer mandrel 820. Other known designs and configurations of a releasable coupler 835, and those discussed above regarding other embodiments, may be used in the place of the one illustrated in the embodiment of FIG. 8 and are within the scope of this disclosure.

As discussed above regarding other embodiments, the releasable coupler 835 can be activated by shearing the shear pin 820*b* and flowing fluid through the interior port 820*c*. The coupling of the tubular housing 805 to the outer mandrel 820 by the releasable coupler 835 provides an operative degree of rigidity to the expansion joint apparatus 800 to allow it to be positioned within the wellbore, effectively. However, after the proper location is achieved, the releasable coupler 835 can be optionally activated to release the tubular housing 805 from the exterior mandrel 820, which allows independent movement between the tubular housing 805 and the exterior mandrel 820. This independent movement allows the expansion joint apparatus 800 to better accommodate or dissipate axial stresses associated with expansion, contraction, or compaction that can occur in a wellbore.

The embodiment of FIG. 8 further comprises an inner mandrel 840 that is located within the outer mandrel 820 and forms an internal flow path 840*a* through the expansion joint apparatus 800, as generally shown. The inner mandrel 840 is spaced apart from the outer mandrel 820 and forms a concentric flow path 820*e* through the expansion joint apparatus 800 that is concentric with the internal flow path 840*a*. As mentioned above, this provides the advantage of providing increased fluid flow capacity through the expansion joint apparatus 800 that is often required in high fluid volume completion processes.

In the embodiment of FIG. 8, the control line 815 may be of any known design. Here, the control line 815 comprises an uphole section 815*a* that is coupled, for example by threads, to an uphole end of the tubular housing 805 and a downhole section 815*b* that is coupled, for example by threads, to a downhole end of the tubular housing 805. A space 815*c* is located within the wall 810 of the tubular housing 805 and forms a portion of the control line 815 and fluidly connects the uphole section 815*a* with the downhole section 815*b*. The control line 815 may be used to operate components located along the length of the wellbore, including any completion assembly attached to the expansion joint apparatus 800.

Figure 9:
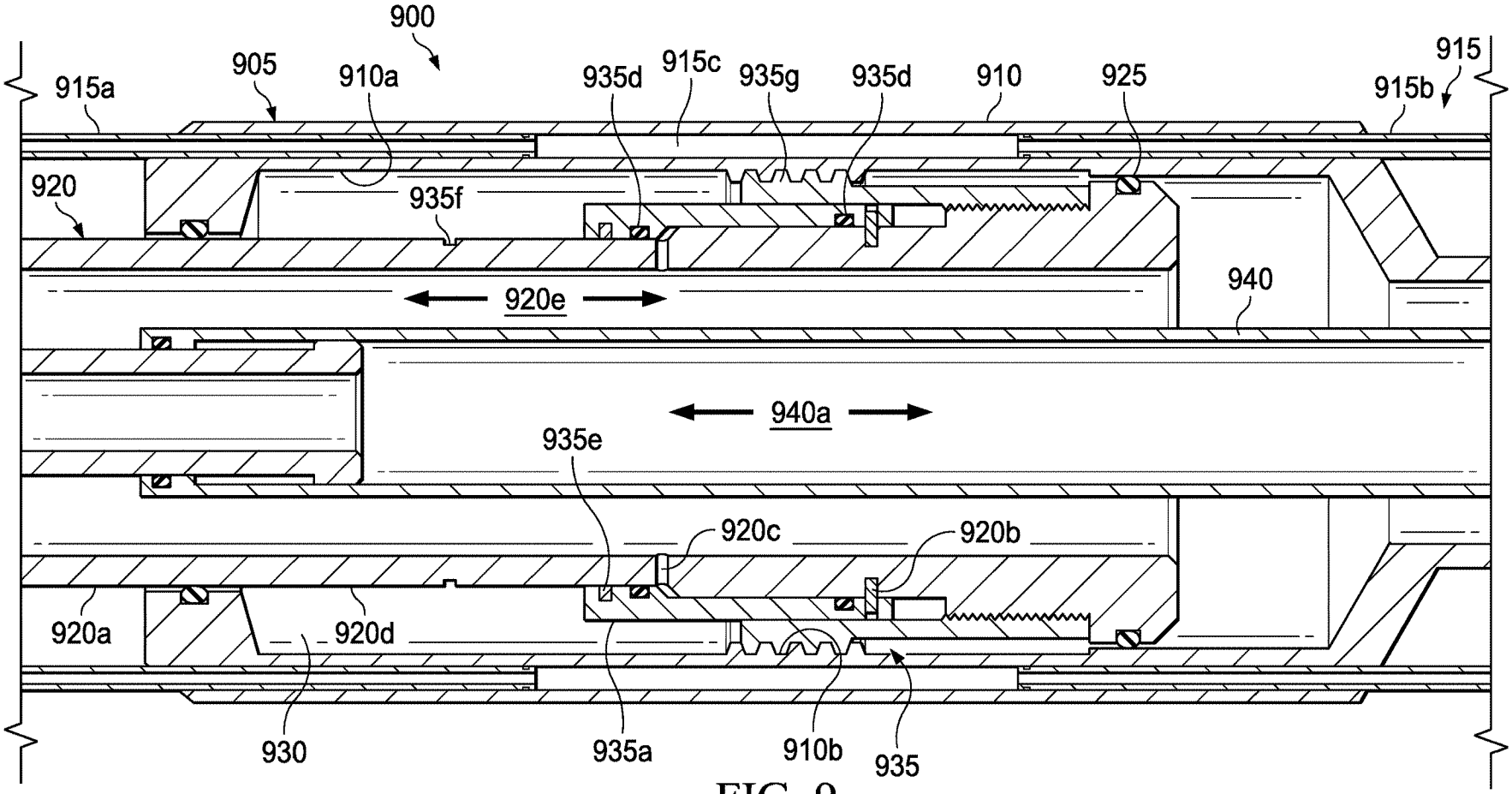
FIG. 9 illustrates a sectional view of an embodiment of an expansion joint according to this disclosure, in a coupled configuration and having a moveable control line extending therethrough.

FIG. 9 illustrates a sectional view of an embodiment of an expansion joint 900, according to this disclosure, in a coupled configuration. This embodiment may be decoupled in a same manner as previously described regarding other embodiments. This embodiment comprises a tubular housing 905 that has a wall 910 with an interior diameter 910*a* and a control line 915 that extends through the tubular housing 905 and within the wall 910, as generally shown. An outer mandrel 920 is located within and extends into the tubular housing 905. One or more elastomeric seals 925 form a fluid seal between the tubular housing 905 and the outer mandrel 920. A portion of the outer diameter 920*a* of the outer mandrel 920 and the interior diameter 910*a* of the tubular housing 905 form a cavity 930 in which a releasable coupler 935 is slidably located. In one embodiment, as shown, the releasable coupler 935 comprises a slidable member 935*a* that is releasably coupled to the outer mandrel 920, for example by a shear pin 920*b*. The slidable member 935*a* is positioned over a fluid port 920*c* that is located through a wall 920*d* of the outer mandrel 920 and allows fluid flow through the fluid port 920*c* to actuate the releasable coupler 935 and release the tubular housing 905 from the outer mandrel 920. The slidable member 935*a* is slidable within the cavity 930 in response to a pressure provided against the slidable member 935*a* through the fluid port 920*c*. In certain embodiments, the slidable member 935*a* may include one or more elastomeric seals 935*d* to provide an operative fluid seal between the slidable member 935*a* and the outer mandrel 920. It may also include a snap ring 935*e* that can be received in a snap ring slot 935*f* formed in the outer diameter 920*a* to hold the slidable member 935*a* in place after activation. A latch 935*g* is located between the interior diameter 910*a* of the tubular housing 910 and an outer diameter 920*a* of the outer mandrel 920 and is supported by the slidable member 935*a*.

As with other embodiments, the latch 935*g* may have a crenelated or notch configuration. The crenels may have any number of geometric configurations, and therefore, is not limited to the configuration shown in this embodiment. A corresponding profile 910*b* is formed in a wall of the interior diameter 910*a* of the tubular housing 910 and is engageable with the latch 935*g* to fix a position of the tubular housing 905 relative to the outer mandrel 920. As with other embodiments, the corresponding profile 910*b* may also be a crenelated profile that corresponds to the latch 935*g* and that allows it to interlock with the corresponding profile 910*b*, and thereby secure the tubing housing 905 to the outer mandrel 920. Other known designs and configurations, and those as discussed above of, the releasable coupler 935 may be used in the place of the one illustrated in the embodiment of FIG. 9 and are within the scope of this disclosure.

As discussed below, in one embodiment, the releasable coupler 935 can be activated by shearing the shear pin 920*b* and flowing fluid through the interior port 920*c*. The coupling of the tubular housing 905 to the outer mandrel 920 by the releasable coupler 935 provides an operative degree of rigidity to the expansion joint apparatus 900 to allow it to be positioned within the wellbore, effectively. However, after the proper location is achieved, the releasable coupler 935 can be optionally activated to release the tubular housing 905 from the exterior mandrel 920, which allows independent movement between the tubular housing 905 and the exterior mandrel 920. This independent movement allows the expansion joint apparatus 900 to better accommodate or dissipate axial stresses associated with expansion, contraction, or compaction that can occur in a wellbore.

The embodiment of FIG. 9 further comprises an inner mandrel 940 that is located within the outer mandrel 920 and forms an internal flow path 940*a* through the expansion joint apparatus 900, as generally shown. The inner mandrel 940 is spaced apart from the outer mandrel 920 and forms a concentric flow path 920*e* through the expansion joint apparatus 900 that is concentric with the internal flow path 940*a*. As mentioned above, this provides the advantage of providing increased fluid flow capacity through the expansion joint apparatus 900 that is often required in high fluid volume completion processes.

The control line 915, in this embodiment, is a moveable piston and comprises an uphole section 915*a* that is movable within a control line cavity 915*c* in the wall 910 and a downhole section 915*b* that is also movable within the control line cavity 915*c* in the wall 910. A space 915*c* that is located between the uphole section 915*a* and downhole section 915*b* allows movement of the control line 915 within the space 915*c*. The control line 915 may be moved in an uphole or downhole direction to operate components located along the length of a tubing that is coupled to the expansion assembly apparatus 900, such as a completion assembly.

Figure 10:
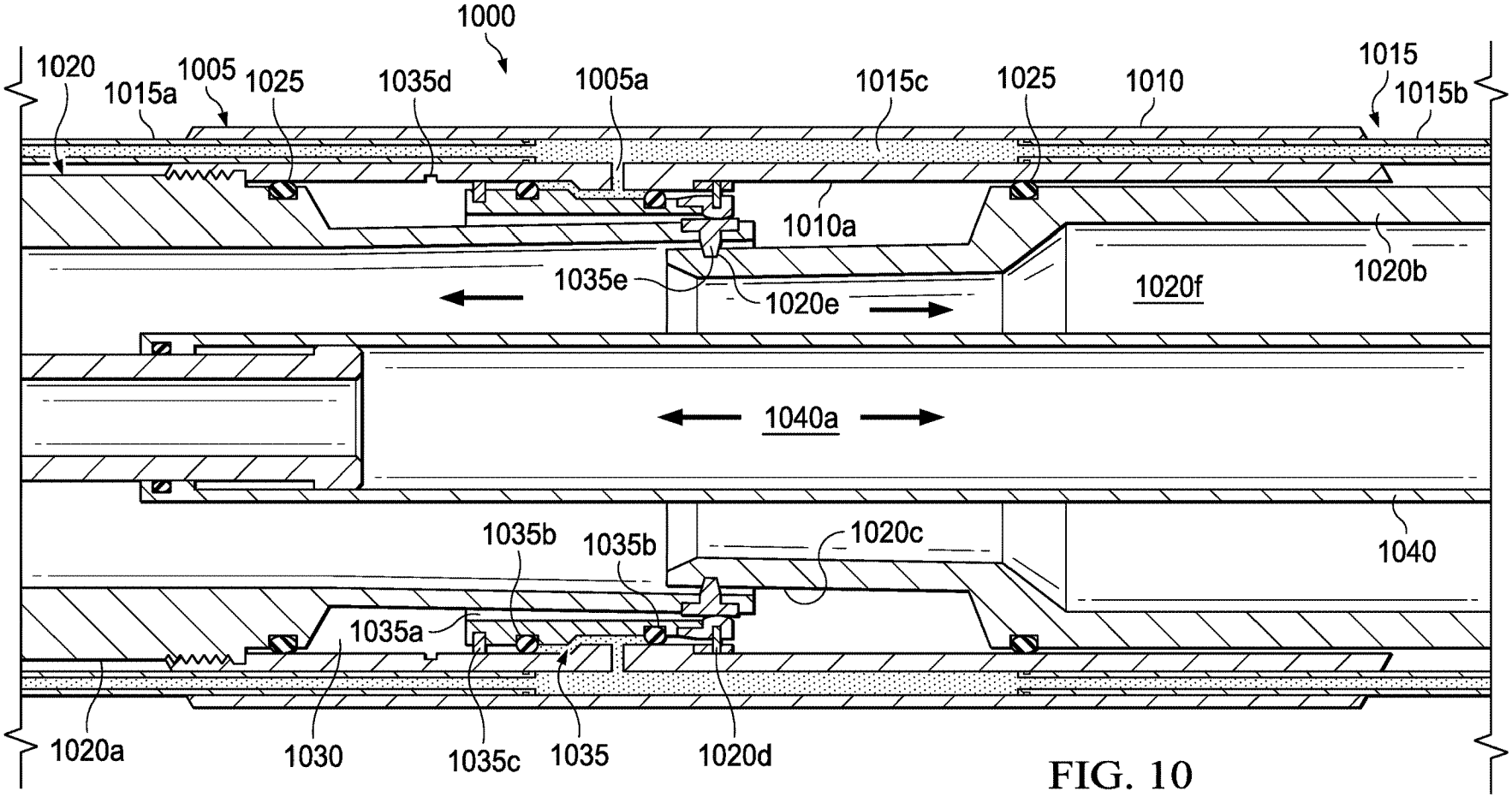
FIG. 10 illustrates a sectional view of an embodiment of an expansion joint according to this disclosure wherein the releasable coupler is activatable through a control line.

FIG. 10 illustrates a sectional view of an embodiment of an expansion joint 1000 according to this disclosure. This embodiment comprises a tubular housing 1005 that has a wall 1010 with an interior diameter 1010*a* and a control line 1015 that extends through the tubular housing 1005 and within the wall 1010, as generally shown. The control line 1015 may be of any known design. Here, the control line 1015 comprises an uphole section 1015*a* and a downhole section 1015*b*. These sections may be coupled to the tubular housing 1005, or they may be slidable within the tubular housing 1005, as in other embodiments. A fluid space 1015*c* located within the wall 1010 of the tubular housing 1005 forms a portion of the control line 1015 and fluidly connects the uphole section 1015*a* with the downhole section 1015*b*. As explained below, the control line 1015 is used to activate a releasable coupler of the expansion joint apparatus 1000, however, it may also be used to activate other components within the wellbore.

An outer mandrel 1020 is located within and extends into the tubular housing 1005. The outer mandrel 1020 comprises at least two sections, an uphole section 1020*a* and a downhole section 1020*b* that are releasably coupled together, as described below. The uphole section 1020*a* may be coupled to the tubular housing 1005 by any known mechanism, such as mechanical threads, or it may be slidable within the tubular housing 1005. One or more elastomeric seals 1025 form a fluid seal between the tubular housing 1005 and the uphole section 1020*a* and downhole section 1020*b* of the outer mandrel 1020, as generally shown.

A space between a portion of the outer diameter 1020*c* of the outer mandrel 1020 and the interior diameter 1010*a* of the tubular housing 1005 forms a cavity 1030 in which a releasable coupler 1035 is slidably located. The releasable coupler 1035 may have different configurations, including the configuration discussed above regarding other embodiments. For example, in this embodiment, the releasable coupler 1035 comprises a slidable member 1035*a*, such as a piston, that releasably couples the uphole section 1020*a* to the downhole section 1020*b* of the outer mandrel 1020, for example by a shear pin 1020*d*. The slidable member 1035*a* is positioned over a fluid port 1005*a* that is located through the wall 1010 of the tubular member 1005 that is fluidly connected to the control line 1015, as generally shown. In another embodiment the fluid space 1015*c* may be a fluid port formed through a wall of the control line 1015 that fluidly connects with the fluid port 1005*a*, which allows it to be used to activate the releasable coupler 1035. A well fluid can be flowed through the control line 1015 and through the fluid port 1005*a* to actuate the releasable coupler 1035 and release the uphole section 1020*a* from the downhole section 1020*b* of the outer mandrel 1020. This releasing action allows movement of the downhole section 1020*b* relative to the tubular housing 1005 and the uphole section 1020*a* of the outer mandrel 1020, which allows the expansion joint apparatus 1000 to better accommodate stresses related to the wellbore. The slidable member 1035*a* is slidable within the cavity 1030 in response to a pressure provided against the slidable member 1035*a* through control line 1015 and the fluid port 1005*a*. In certain embodiments, the slidable member 1035*a* may include one or more elastomeric seals 1035*b* to provide an operative fluid seal between the slidable member 1035*a* and the tubular housing 1005. It may also include a snap ring 1035*c* that can be received in a snap ring slot 1035*d* formed in the inner diameter 1010*a* of the tubular member 1005 to hold the slidable member 1035*a* in place after activation. A latch 1035*e* is located between the slidable member 1035*a* and the outer diameter 1020*c* of the outer mandrel 1020 and is held in a latched position by the slidable member 1035*a*.

The latch 1035*e* releasably couples the uphole section 1020*a* to the downhole section 1020*b* of the outer mandrel 1020, and it may have different types of latching profiles, such as those discussed above regarding other embodiments. A corresponding profile 1020*e* is formed in the outer diameter wall 1020*c* of the outer mandrel 1020 and is configured to receive the latch 1035*e* and fix a position of the uphole section 1020*a* to the downhole section 1020*b* of the outer mandrel 1020. As with other embodiments, the corresponding profile 1020*e* may have different types of corresponding profiles, such as those discussed above regarding other embodiments. Other known designs and configurations of the releasable coupler 1035 may be used in the place of the one illustrated in the embodiment of FIG. 10 and are within the scope of this disclosure.

In FIG. 10, the releasable coupler 1035 is activated by shearing the shear pin 1020*d* and flowing fluid through the control line 1015 and the interior port 1005*a*. The pressure slides the slidable member 1035*a* uphole to allow the latch 1035*e* to release from the corresponding profile 1020*e*, which releasably decouples the uphole section 1020*a* from the downhole section 1020*b* of the outer mandrel 1020. The coupling of the tubular housing 1005 to the outer mandrel 1020, and the coupling of the uphole section 1020*a* to the downhole section 1020*b* by the releasable coupler 1035 provides an operative degree of rigidity to the expansion joint apparatus 1000 to allow it to be positioned within the wellbore, effectively. However, after the proper location is achieved, the releasable coupler 1035 can be optionally activated, as described below, to release the uphole section 1020*a* from the downhole section 1020*b* of outer mandrel 1020, which allows independent movement of the downhole section 1020*b* relative to the uphole section 1020*a* and the tubular housing 1005. This independent movement allows the expansion joint apparatus 1000 to better accommodate or dissipate axial stresses associated with expansion, contraction, or compaction that can occur in a wellbore.

The expansion joint apparatus 1000 of FIG. 10 further comprises an inner mandrel 1040 that is located within the outer mandrel 1020 and forms an internal flow path 1040*a* through the expansion joint apparatus 1000, as generally shown. The inner mandrel 1040 is spaced apart from the outer mandrel 1020 and forms a concentric flow path 1020*f* through the expansion joint apparatus 1000 that is concentric with the internal flow path 1040*a*. As mentioned above, this provides the advantage of providing increased fluid flow capacity through the expansion joint apparatus 1000 that is often required in high fluid volume completion processes. This increased flow volume, as provided by the embodiments of this disclosure, increases the flow path and allows for more efficient fluid return to the surface, thereby reducing rig time and associated costs. The increase in flow area, as provided by the concentric flow path 1020*f* and internal flow path 1040*a*, provides sufficient flow rate to push a completion fluid, such as a frac fluid, uphole. Additionally, these concentric paths increase the fluid flow through the expansion joint apparatus 1000, and as such, provide significantly more flow rate through the expansion joint apparatus 1000, while also accommodating well movement stresses, as discussed above.

The invention having been generally described, the following embodiments are given by way of illustration and are not intended to limit the specification of the claims in any manner Embodiments herein comprise:

An expansion joint apparatus, comprising: a tubular housing, an outer mandrel located within the tubular housing, and an inner mandrel located within the outer mandrel. The inner mandrel has an internal flow path through the expansion joint and is spaced apart from the outer mandrel to form a concentric flow path through the expansion joint concentric with the internal flow path. A releasable coupler is positioned within a cavity located between an interior diameter of the tubular housing and an outer diameter of the outer mandrel that releasably couples the outer mandrel to the tubular housing.

Another embodiment comprises a well completion apparatus. The well completion apparatus comprises a tubing string located within a wellbore and an expansion joint apparatus coupled to the tubing string. The tubing comprises a tubular housing, an outer mandrel located within the tubular housing, and an inner mandrel located within the outer mandrel. The inner mandrel has an internal flow path through the expansion joint and is spaced apart from the outer mandrel to form a first concentric flow path through the expansion joint concentric with the internal flow path. A releasable coupler is positioned within a cavity located between an interior diameter of the tubular housing and an outer diameter of the outer mandrel that releasably couples the outer mandrel to the tubular housing to allow movement of the tubular housing relative to the outer mandrel. A completion assembly is coupled to the expansion joint apparatus and has a central flow path connected to the internal flow path and a second concentric flow path connected with the first concentric flow path.

Element 1: wherein the releasable coupler comprises: a fluid port located through a wall of the outer mandrel or the tubular housing that allows fluid through the fluid port to actuate the releasable coupler to release the tubular housing from the outer mandrel.

Element 2: wherein the fluid port extends through the wall of the outer mandrel and opens into the concentric flow path, and the releasable coupler comprises; a slidable member releasably coupled to the outer mandrel and positioned over the fluid port and being slidable within the cavity in response to a pressure provided against the slidable member through the fluid port; a latch located between the interior diameter of the tubular housing and the outer diameter of the outer mandrel, and supported by the slidable member; and a corresponding profile formed in a wall of the interior diameter of the tubular housing, the corresponding profile engageable with the latch to fix a position of the tubular housing relative to the outer mandrel.

Element 3: wherein the slidable member is a piston releasably coupled to the outer mandrel and moveable within the cavity to unsupport the latch, the latch having a first crenelated profile, and the corresponding profile having a second crenelated profile that cooperatively engages the first crenelated profile to hold the tubular housing in a fixed position relative to the outer mandrel.

Element 4: wherein the slidable member is a piston releasably coupled to the outer mandrel and moveable within the cavity to unsupport the latch, the latch comprising a latching lug, and the corresponding profile having a lug cavity configured to receive the latching lug therein to hold the tubular housing in a fixed position relative to the outer mandrel.

Element 5: further comprising a control line located within a wall of the tubular housing and extending along a longitudinal length of the tubular housing, and wherein the fluid port extends through the wall of the tubular housing to form a flow path from the control line to the cavity, and the releasable coupler comprises: a slidable member releasably coupled to the interior diameter of the tubular housing and positioned over the fluid port and being slidable within the cavity in response to a pressure provided against the slidable member through the fluid port; a latch located between and supported by the slidable member; and a corresponding profile formed in a wall of the outer diameter of the outer mandrel, the latch engageable with the corresponding profile formed in the outer diameter of the outer mandrel to fix a position of the tubular housing relative to the outer mandrel.

Element 6: wherein the control line is fixed within the wall of the tubular housing or is movable within wall of the tubular housing.

Element 7: wherein the releasable coupler comprises: a fluid port located through a wall of the outer mandrel or the tubular housing that allows fluid through the fluid port to actuate the releasable coupler to release the tubular housing from the outer mandrel for movement therebetween.

Element 8: wherein the fluid port extends through the wall of the outer mandrel and opens into the concentric flow path, and the releasable coupler comprises; a slidable member releasably coupled to the outer mandrel and positioned over the fluid port and being slidable within the cavity in response to a pressure provided against the slidable member through the fluid port; a latch located between the interior diameter of the tubular housing and the outer diameter of the outer mandrel, and supported by the slidable member; and a corresponding profile formed in a wall of the interior diameter of the tubular housing, the corresponding profile engageable with the latch to fix a position of the outer tubular housing relative to the outer mandrel.

Element 9: wherein the slidable member is a piston releasably coupled to the outer mandrel and moveable within the cavity to unsupport the latch, the latch having a first crenelated profile, and the corresponding profile having a second crenelated profile that cooperatively engages the first crenelated profile to hold the tubular housing in a fixed position relative to the outer mandrel.

Element 10: wherein the slidable member is a piston releasably coupled to the outer mandrel and moveable within the cavity to unsupport the latch, the latch comprising a latching lug, and the corresponding profile having a lug cavity configured to receive the latching lug therein to hold the tubular housing in a fixed position relative to the outer mandrel.

Element 11: further comprising a control line located within a wall of the tubular housing and extending along a longitudinal length of the tubular housing, and wherein the fluid port extends through the wall of the tubular housing to form a flow path from the control line to the cavity, and wherein the outer mandrel comprises first and second sections that are releasably coupled together, the first section being coupled to the tubular housing, and the releasable coupler comprises: a slidable member releasably coupled to the interior diameter of the tubular housing and positioned over the fluid port and being slidable within the cavity in response to a pressure provided against the slidable member through the control line and the fluid port; a latch located between the slidable member and an outer diameter of the second outer mandrel and being held in a latched position by the slidable member; and a corresponding profile formed in a wall of the outer diameter of the second outer mandrel, the corresponding profile engageable with the latch to fix a position of the first outer mandrel relative to the second outer mandrel.

Element 12: wherein the control line is fixed within the wall of the tubular housing or is movable within the wall of the tubular housing.

Element 13: wherein the latch configured to be releasable to allow independent movement of the second mandrel relative to the first outer mandrel and the tubular housing Element 14: wherein the completion assembly comprises an inner tubing through which the central flow path extends that connects with the internal flow path, and an outer tubing, through which the second concentric flow path extends and that connects to the is coupled to the tubular housing.

Element 15: wherein the completion assembly comprises a ported adapter sub, and the inner tubing and outer tubing are coupled by the ported adapter sub.

Element 16: wherein the inner tubing is removably coupled to the ported adapter sub by a shear pin configured to shear and decouple the inner tubing from the outer tubing to allow independent movement of the inner tubing relative to the outer tubing.

Element 17: wherein the ported adapter sub is coupled to one of the inner tubing or the outer tubing with the other of the inner tubing or the outer tubing to move independent of the one of the inner tubing or the outer tubing to which the ported adapter sub is coupled.

Element 18: further comprising a limit shear pin located on the other of the inner tubing or outer tubing that is not coupled to the ported adapter sub, wherein the ported adapter sub is actionable against the limit shear pin to shear the limit shear pin when a wellbore stress causes the ported adapter sub to move against and apply a shearing force against the limit shear pin to allow additional independent downhole or uphole movement of the outer tubing or inner tubing.

Those skilled in the art to which this application relates will appreciate that other and further additions, deletions, substitutions and modifications may be made to the described embodiments.

What is claimed is:

1. An expansion joint apparatus, comprising:

a tubular housing;

an outer mandrel located within the tubular housing;

an inner mandrel located within and axially slidable relative to the outer mandrel, the inner mandrel having an internal flow path through the expansion joint, the inner mandrel spaced apart from the outer mandrel to form a concentric flow path through the expansion joint concentric with the internal flow path; and a releasable coupler positioned within a cavity located between an interior diameter of the tubular housing and an outer diameter of the outer mandrel that releasably couples the outer mandrel to the tubular housing.

2. The expansion joint apparatus of claim 1, wherein the releasable coupler comprises:

a fluid port located through a wall of the outer mandrel or the tubular housing that allows fluid through the fluid port to actuate the releasable coupler to release the tubular housing from the outer mandrel.

3. The expansion joint apparatus of claim 2, wherein the fluid port extends through the wall of the outer mandrel and opens into the concentric flow path, and the releasable coupler comprises;

a slidable member releasably coupled to the outer mandrel and positioned over the fluid port and being slidable within the cavity in response to a pressure provided against the slidable member through the fluid port;

a latch located between the interior diameter of the tubular housing and the outer diameter of the outer mandrel, and supported by the slidable member; and a corresponding profile formed in a wall of the interior diameter of the tubular housing, the corresponding profile engageable with the latch to fix a position of the tubular housing relative to the outer mandrel.

4. The expansion joint apparatus of claim 3, wherein the slidable member is a piston releasably coupled to the outer mandrel and moveable within the cavity to unsupport the latch, the latch having a first crenelated profile, and the corresponding profile having a second crenelated profile that cooperatively engages the first crenelated profile to hold the tubular housing in a fixed position relative to the outer mandrel.

5. The expansion joint apparatus of claim 3, wherein the slidable member is a piston releasably coupled to the outer mandrel and moveable within the cavity to unsupport the latch, the latch comprising a latching lug, and the corresponding profile having a lug cavity configured to receive the latching lug therein to hold the tubular housing in a fixed position relative to the outer mandrel.

6. The expansion joint apparatus of claim 2, further comprising a control line located within a wall of the tubular housing and extending along a longitudinal length of the tubular housing, and wherein the fluid port extends through the wall of the tubular housing to form a flow path from the control line to the cavity, and the releasable coupler comprises:

a slidable member releasably coupled to the interior diameter of the tubular housing and positioned over the fluid port and being slidable within the cavity in response to a pressure provided against the slidable member through the fluid port;

a latch located between and supported by the slidable member; and a corresponding profile formed in a wall of the outer diameter of the outer mandrel, the latch engageable with the corresponding profile formed in the outer diameter of the outer mandrel to fix a position of the tubular housing relative to the outer mandrel.

7. The expansion joint apparatus of claim 6, wherein the control line is fixed within the wall of the tubular housing or is movable within wall of the tubular housing.

8. The expansion joint apparatus of claim 1, wherein the internal flow path and the concentric flow path are configured to simultaneously flow fluid in a same or opposite directions.

9. The expansion joint apparatus of claim 1, wherein the inner mandrel axially expands relative to the outer mandrel.

10. The expansion joint apparatus of claim 1, wherein the inner mandrel axially contracts relative to the outer mandrel.

11. A well completion apparatus, comprising:

a tubing string located within a wellbore;

an expansion joint apparatus coupled to the tubing string, comprising:

a tubular housing;

an outer mandrel located within the tubular housing;

an inner mandrel located within and axially slidable relative to the outer mandrel, the inner mandrel having an internal flow path through the expansion joint, the inner mandrel spaced apart from the outer mandrel to form a first concentric flow path through the expansion joint concentric with the internal flow path; and a releasable coupler positioned within a cavity located between an interior diameter of the tubular housing and an outer diameter of the outer mandrel that releasably couples the outer mandrel to the tubular housing to allow movement of the tubular housing relative to the outer mandrel; and a completion assembly coupled to the expansion joint apparatus having a central flow path connected to the internal flow path and a second concentric flow path connected with the first concentric flow path.

12. The well completion apparatus of claim 11, wherein the releasable coupler comprises:

a fluid port located through a wall of the outer mandrel or the tubular housing that allows fluid through the fluid port to actuate the releasable coupler to release the tubular housing from the outer mandrel for movement therebetween.

13. The well completion apparatus of claim 12, wherein the fluid port extends through the wall of the outer mandrel and opens into the concentric flow path, and the releasable coupler comprises;

a slidable member releasably coupled to the outer mandrel and positioned over the fluid port and being slidable within the cavity in response to a pressure provided against the slidable member through the fluid port;

a latch located between the interior diameter of the tubular housing and the outer diameter of the outer mandrel, and supported by the slidable member; and a corresponding profile formed in a wall of the interior diameter of the tubular housing, the corresponding profile engageable with the latch to fix a position of the outer tubular housing relative to the outer mandrel.

14. The well completion apparatus of claim 13, wherein the slidable member is a piston releasably coupled to the outer mandrel and moveable within the cavity to unsupport the latch, the latch having a first crenelated profile, and the corresponding profile having a second crenelated profile that cooperatively engages the first crenelated profile to hold the tubular housing in a fixed position relative to the outer mandrel.

15. The well completion apparatus of claim 13, wherein the slidable member is a piston releasably coupled to the outer mandrel and moveable within the cavity to unsupport the latch, the latch comprising a latching lug, and the corresponding profile having a lug cavity configured to receive the latching lug therein to hold the tubular housing in a fixed position relative to the outer mandrel.

16. The well completion apparatus of claim 12, further comprising a control line located within a wall of the tubular housing and extending along a longitudinal length of the tubular housing, and wherein the fluid port extends through the wall of the tubular housing to form a flow path from the control line to the cavity, and wherein the outer mandrel comprises first and second sections that are releasably coupled together, the first section being coupled to the tubular housing, and the releasable coupler comprises:

a slidable member releasably coupled to the interior diameter of the tubular housing and positioned over the fluid port and being slidable within the cavity in response to a pressure provided against the slidable member through the control line and the fluid port;

a latch located between the slidable member and an outer diameter of the second outer mandrel and being held in a latched position by the slidable member; and a corresponding profile formed in a wall of the outer diameter of the second outer mandrel, the corresponding profile engageable with the latch to fix a position of the first outer mandrel relative to the second outer mandrel.

17. The well completion apparatus of claim 16, wherein the control line is fixed within the wall of the tubular housing or is movable within the wall of the tubular housing.

18. The well completion apparatus of claim 16, wherein, the latch configured to be releasable to allow independent movement of the second mandrel relative to the first outer mandrel and the tubular housing.

19. The well completion apparatus of claim 11, wherein the completion assembly comprises an inner tubing through which the central flow path extends that connects with the internal flow path, and an outer tubing through which the second concentric flow path extends and that connects with the first concentric flow path.

20. The well completion apparatus of claim 19, wherein the completion assembly comprises a ported adapter sub, and the inner tubing and outer tubing are coupled by the ported adapter sub.

21. The well completion apparatus of claim 20, wherein the inner tubing is removably coupled to the ported adapter sub by a shear pin configured to shear and decouple the inner tubing from the outer tubing to allow independent movement of the inner tubing relative to the outer tubing.

22. The well completion apparatus of claim 19, wherein the ported adapter sub is coupled to one of the inner tubing or the outer tubing with the other of the inner tubing or the outer tubing to move independent of the one of the inner tubing or the outer tubing to which the ported adapter sub is coupled.

23. The well completion apparatus of claim 22, further comprising a limit shear pin located on the other of the inner tubing or outer tubing that is not coupled to the ported adapter sub, wherein the ported adapter sub is actionable against the limit shear pin to shear the limit shear pin when a wellbore stress causes the ported adapter sub to move against and apply a shearing force against the limit shear pin to allow additional independent downhole or uphole movement of the outer tubing or inner tubing.

24. The well completion apparatus of claim 11, wherein the internal flow path and the concentric flow path are configured to simultaneously flow fluid in a same or opposite directions.

25. The well completion apparatus of claim 11, wherein the inner mandrel axially expands relative to the outer mandrel.

26. The well completion apparatus of claim 11, wherein the inner mandrel axially contracts relative to the outer mandrel.

* * * * *